United States Patent [19]

Miyazawa

[11] 4,195,245

[45] Mar. 25, 1980

[54] SEALED BEAM LAMP FOR AUTOMOBILE

[75] Inventor: Hideo Miyazawa, Mitaka, Japan

[73] Assignee: Stanley Electric Co., Ltd., Tokyo, Japan

[21] Appl. No.: 914,491

[22] Filed: Jun. 12, 1978

[30] Foreign Application Priority Data

Jun. 20, 1977 [JP] Japan ..... 52-80826[U]

[51] Int. Cl.[2] ..... H01J 5/16; H01J 61/40; H01K 1/26; H01K 1/30

[52] U.S. Cl. ..... 313/113; 313/115; 313/316; 313/222

[58] Field of Search ..... 313/113, 114, 115, 316, 313/222

[56] References Cited

U.S. PATENT DOCUMENTS

| | | | |
|---|---|---|---|
| 3,165,659 | 1/1965 | Bottone | 313/115 |
| 3,513,347 | 5/1970 | Murray et al. | 313/115 |
| 3,646,385 | 2/1972 | Wichert | 313/114 |
| 3,904,904 | 9/1975 | Meinecke et al. | 313/113 |
| 4,140,939 | 2/1979 | Bonazoli et al. | 313/115 |

*Primary Examiner*—Saxfield Chatmon, Jr.
*Attorney, Agent, or Firm*—Frishauf, Holtz, Goodman & Woodward

[57] ABSTRACT

A sealed beam lamp for an automobile which is provided with a halogen bulb having a plurality of filaments. The filaments are arranged in a vertical direction to a rotary axis of a reflector of the sealed beam lamp.

6 Claims, 1 Drawing Figure

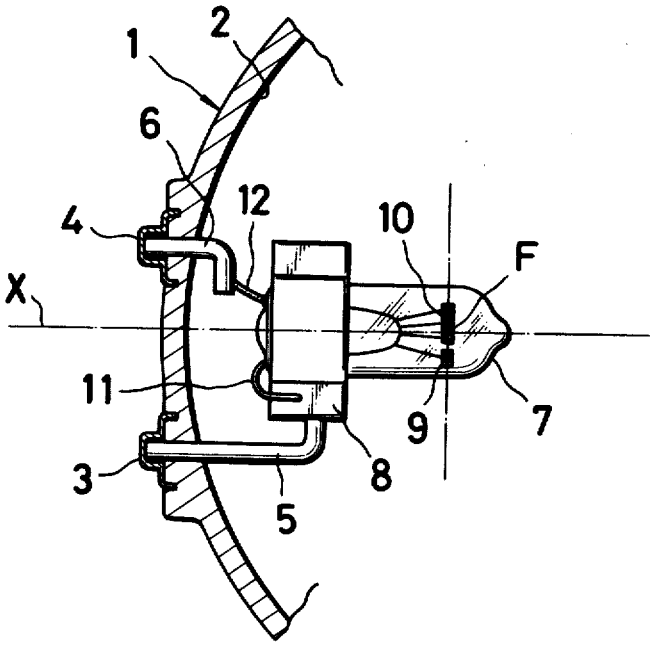
1
2
6
12
4
10
F
X
11
9
7
3
8
5

SEALED BEAM LAMP FOR AUTOMOBILE

BACKGROUND OF THE INVENTION

The present invention relates to a head lamp for an automobile, and more particularly to a sealed beam lamp having a halogen bulb.

Generally, in a sealed beam lamp enclosing a halogen bulb, the bulb has a high beam filament and a low beam filament arranged therein. These filaments are arranged to be parallel in a rotary axis of a reflector when disposed to the sealed beam lamp. These filament have a desired length respectively. Therefore, if they were arranged so that a light source is brought to a desired position relative to the focal point on the rotary axis, the position of the light source is out of due to the length of the filaments and characteristics of light distribution vary. The characteristics of light distribution in the above mentioned lamp, particularly in a sealed beam lamp, are defects that a distant projection of light becomes bad because the extremely downward light beam increases and a limitation to forward sight occurs when the filaments are arranged to not emit an upward dazzle light beam.

SUMMARY OF THE INVENTION

It is an object of the invention to provide a sealed beam lamp for an automobile which eliminates the defects in the prior art as mentioned above.

It is another object of the invention to provide a sealed beam lamp for an automobile which has no limitation to a forward sight and which has a good projection of light to distance.

It is a further object of the invention to provide a sealed beam lamp for an automobile in which workability is improved when mounting the high beam filament for running and the low beam filament for opposed vehicles in a halogen bulb.

With the present invention, a sealed beam lamp for an automobile has a halogen bulb in which a filament for running (high beam) and a filament for opposed vehicles (low beam) are arranged in a vertical direction to a rotary axis of a reflector.

BRIEF DESCRIPTION OF THE DRAWING

The single FIGURE is a longitudinal sectional view showing the essential parts of a sealed beam lamp for an automobile according to the present invention.

DETAILED DESCRIPTION OF PREFERRED EMBODIMENT

Referring now to the drawing, there is generally shown a sealed beam lamp envelope made entirely from glass by reference numeral 1. On a back side of a reflector 2 of the sealed beam lamp is mounted a halogen bulb 7 through a plurality of ferrules 3 and 4, and a plurality of support wires 5 and 6. One (wire 5) of the support wires 5 and 6 is provided with a retaining portion 8 by means of which a base of the halogen bulb is fixed and retained. In the halogen bulb 7 are disposed an elongated filament 9 for running (high beam filament) and an elongated filament 10 for opposed vehicles (low beam filaments). These filaments are connected with lead wires 11 and 12, respectively, which in turn are connected with the support wires 5 and 6.

Both of the filaments 9 and 10 are arranged vertically to a rotary axis x of the reflector 2 in the halogen bulb 7. The characteristic of the present invention is based on this vertical arrangement of the filaments.

When the filament 9 for running is disposed in the halogen bulb 7 so that it is located at a focal point, all of the light emitted from the filament 9 for running and reflected by the reflector 2 will become parallel light. In this case, by shifting upwardly the filament 10 for opposed vehicles at the vertical position, the light emitted by filemant 10 and reflected by the reflector 2 is directed downwardly. Further, the direct lights emitted from both of the filaments and directed upwardly is cut off or blocked by, for example, a hood or the like so as to obtain a proper distribution of light for a head lamp.

As understood from the above description, the sealed beam lamp according to the invention comprises a halogen bulb in which the filaments for running and for opposed vehicles are arranged vertically to the rotary axis of the reflector. Consequently, the sealed beam lamp as the following effects: (a) the lamp can be easily positioned relative to the focal point and is not subject to the limitation of the forward sight, (b) if the filaments have some length, the lamp has good projection of light to concentrically illuminate the distance without decreasing the intensity of illumination when the desired positioning is realized because the light source is located at the fixed vertical position, (c) it is easy to dispose the halogen bulb in the sealed beam lamp, and (d) good workability is obtained in disposing the filaments for running and for opposed vehicles in the halogen bulb since they can be easily properly disposed in the bulb by moving up and down at the same position.

What is claimed is:

1. A sealed beam lamp for an automobile comprising:
a reflector having a rotary axis,
a halogen bulb mounted on said reflector, and
a plurality of filaments disposed in said halogen bulb, said plurality of filaments being arranged one above the other in a substantially vertical direction substantially on a common line running in a direction perpendicular to said rotary axis of said reflector.

2. A sealed beam lamp according to claim 1, wherein said plurality of filaments comprises a high beam filament for running and a low beam filament for opposed vehicles.

3. A sealed beam lamp according to claim 2, wherein both of said filaments are arranged by shifting them up and down at the same position in said halogen bulb.

4. A sealed beam lamp according to either of claims 1 or 2 wherein said rotary axis is generally horizontal and said line on which said filaments are arrranged is generally vertical.

5. A sealed beam lamp according to claim 4 wherein each of said filaments is an elongated filament having an axis which is substantially colinear with said generally vertical line on which they are arranged.

6. A sealed beam lamp according to claim 1 wherein each of said filaments is an elongated filament having an axis which is substantially colinear with said line on which they are arranged.

* * * * *